United States Patent [19]

Trammell, Jr.

[11] 4,238,133

[45] Dec. 9, 1980

[54] DOOR-LOCK BUTTON ASSEMBLY

[76] Inventor: Earl M. Trammell, Jr., EMT Enterprises, Inc., P.O. Box 435, St. Louis, Mo. 63166

[21] Appl. No.: 873,248

[22] Filed: Jan. 30, 1978

[51] Int. Cl.[3] ..... E05C 21/02

[52] U.S. Cl. ..... 292/347; 292/336.3

[58] Field of Search ..... 292/1, 336.3, 347

[56] References Cited

U.S. PATENT DOCUMENTS

| | | | |
|---|---|---|---|
| 2,735,289 | 2/1956 | Trammell, Jr. | 70/181 |
| 2,779,619 | 1/1957 | Taylor | 292/347 |
| 2,814,197 | 11/1957 | Probala et al. | 70/181 |
| 3,247,691 | 4/1966 | Martin | 292/1 |
| 3,915,485 | 10/1975 | Richman et al. | 292/347 |

*Primary Examiner*—Richard E. Moore

*Attorney, Agent, or Firm*—Cohn, Powell & Hind

[57] ABSTRACT

A door-lock button assembly for use on the door of a closed-body automotive vehicle in which a lock button is selectively movable between a door-locking and door-unlocking positions. A housing is mounted on an inside frame element and embraces the lock button, the button being received in the housing when in the door-locking position. The housing includes an aperture, and the lock button includes relatively smooth surfaces exposed through the aperture. The aperture is of a size proportioned to permit manual access to and actuation of the lock button when in the door-locking position and to preclude gripping actuation of the lock button when in the door-locking position by any instrument. The aperture is at least partially defined by lateral housing margins that extend outwardly of the lock button a distance sufficient for precluding effective engagement of the lock button by an instrument extending substantially transversely of the aperture. Preferably, the housing includes a pair of substantially opposed apertures, and the lock button is located inwardly of a substantially straight reference line passed transversely between the outer edges of the lateral margins of each aperture.

3 Claims, 4 Drawing Figures

DOOR-LOCK BUTTON ASSEMBLY

BACKGROUND OF THE INVENTION

This invention relates generally to improvements in a door lock button assembly for use on the door of a closed-body automotive vehicle, and more particularly to an improved assembly of this type that provides a major deterrent against break-ins.

It has long been conventional to utilize a digitally-actuated button mounted on the inside door frame of an automobile door to condition the latch mechanism of the door. A serious problem exists in that when the door is closed and the button is positioned in the door-locking position, it is possible for thieves and other unauthorized persons to unlock the door and gain access to the automobile interior. This break-in is usually accomplished by inserting an instrument such as a wire or the like, through the door opening and gripping the lock button and moving it to the door-unlocking position.

In an effort to deter such unauthorized break-ins, it is well known that a lock button that has a long tapered configuration does offer some protection because it is difficult for certain wires to effectively grip such a lock button surface. However, it has been found that even these long tapered lock buttons can be gripped and actuated by rubber or plastic coated wire, the coating providing sufficient friction for this purpose.

These are available lock button guarding devices that utilizes lock button shields, such as the type disclosed in applicant's U.S. Pat. No. 2,708,845. However, the structural arrangement and cooperation of the particular lock button and guarding shield in these devices is such that its purpose is to prevent the unintended, casual or otherwise unwanted digital manipulation of the door lock button from the door-locking position to the door-unlocking position from inside the automobile. Its special objective is to make it difficult for small children to unlatch the door from inside the automobile. The button can be actuated by an instrument such as a wire. The purpose of the device is not to preclude break-in from outside the automobile.

SUMMARY OF THE INVENTION

The present door-lock button assembly includes a housing that is mounted on an inside door frame element, and embraces a lock button that is selectively movable between door-locking and door-unlocking positions, the lock button being received in the housing when in the door-locking position. The housing includes an aperture, and the lock button includes relatively smooth surfaces exposed through the aperture. The aperture is of a size proportioned to permit manual access to and actuation of lock button when in the door-locking position, and to preclude effective gripping actuation of the lock button when in the door-locking position by any instrument.

The aperture in the housing is at least partially defined by lateral housing margins that extent outwardly of the lock button a distance sufficient to preclude effective engagement of the lock button by an instrument extending substantially transversely of the aperture. More particularly, the lock button is located inwardly of a substantially straight reference line passed transversely between the outer edges of the lateral housing margins.

In the door-lock button assembly, the housing aperture is disposed to face in a direction generally toward or away from the door window. Preferably, the housing of the door-lock button assembly includes a pair of diametrically opposed apertures, and the housing is arranged so that one aperture faces toward the window and the other aperture faces away from the window.

DESCRIPTION OF THE PREFERRED EMBODIMENT

Figure 1:
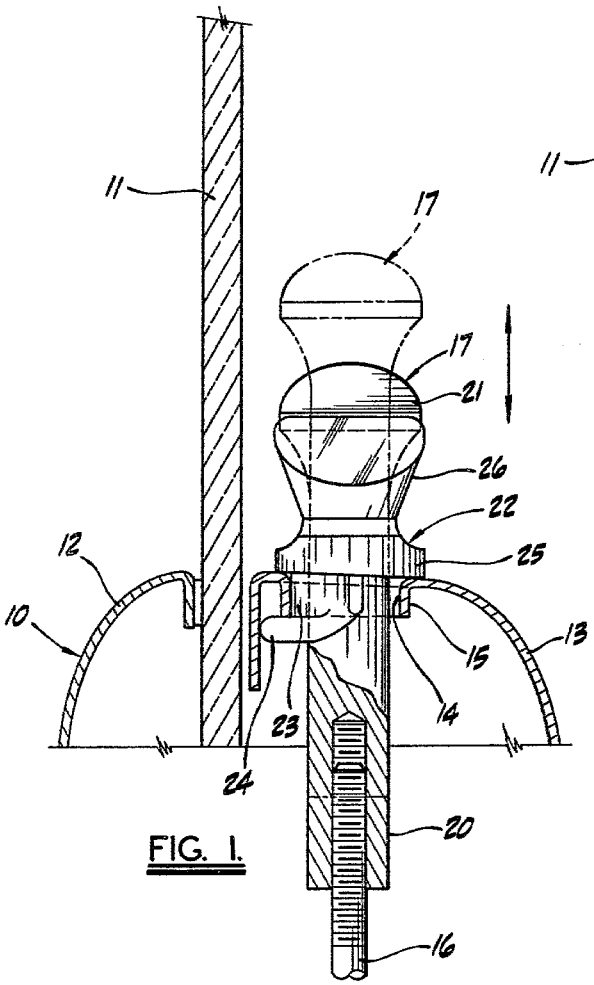
FIG. 1 is an enlarged sectional view of the lock button assembly mounted on an automobile door, the lock button being illustrated in its door-locking position in full lines and in its door-unlocking position in phantom lines.

Referring now by characters of reference to the drawing, it will be understood that a door generally indicated by 10 is for a closed-body automative vehicle. The door 10 includes a glass window 11 that passes through and between an outside window frame element 12 and an inside window frame element 13. Formed in the inside frame element 13 is a substantially circular opening 14 defined by an annular, depending flange 15, the opening 14 being located substantially adjacent the window 11. A lock rod 16 is located in the door 10 substantially below the window frame element 13. As is conventional, the lock rod 16 is operatively connected to the latching mechanism (not shown) of the door 10, and is utilized to condition such latching mechanism to lock and unlock the door 10.

The door-lock button assembly includes a lock button referred to by 17 that is located in the button opening 14. The lock button 17 includes a lower shank portion 20 that is threadedly attached to the upper end of lock rod 16, and includes a relatively enlarged button head 21, that is disposed above the inside frame element 13.

A substantially tubular housing, indicated by 22, is mounted on the frame element 13, and embraces the lock button 17. The housing 22 includes a depending flange 23 that conforms to and closely interfits part of the button opening 14. A laterally projecting hook 24, formed integrally with the flange 23, underlies and engages the opening flange 15 to secure the housing 22 to the inside frame element 13. The housing 22 includes an annular shoulder 25 that seats on the top of frame element 13 and closes the button opening 14. Further, the housing 22 includes a flared, enlarged upper portion 26 that accommodates and receives the enlarged button head 21 of button 17.

Figure 2:
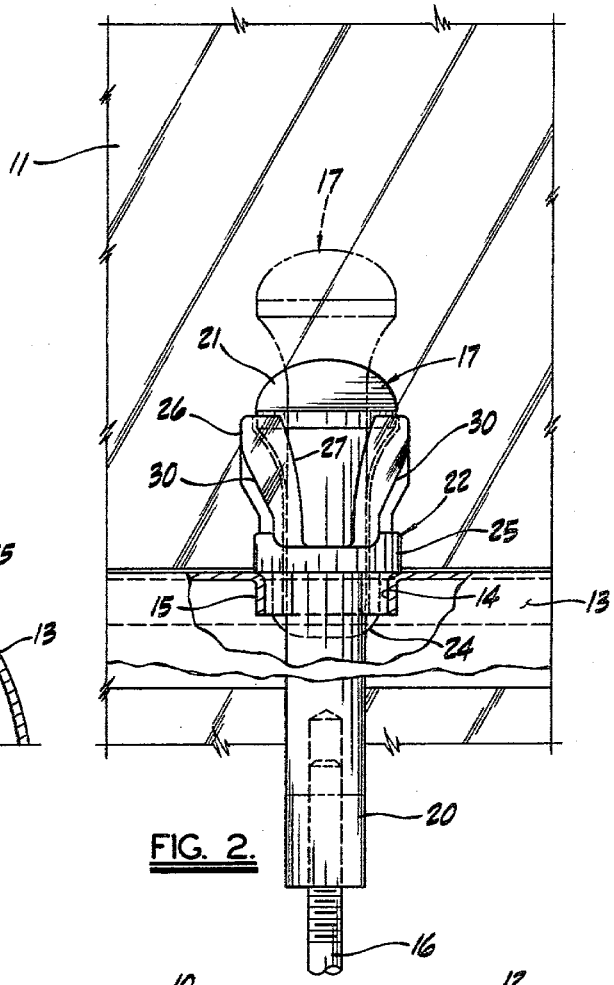
FIG. 2 is a fragmentary, side elevational view of the assembly shown in FIG. 1, with the frame element being partially cut away to illustrate the housing mounting.
Figure 3:
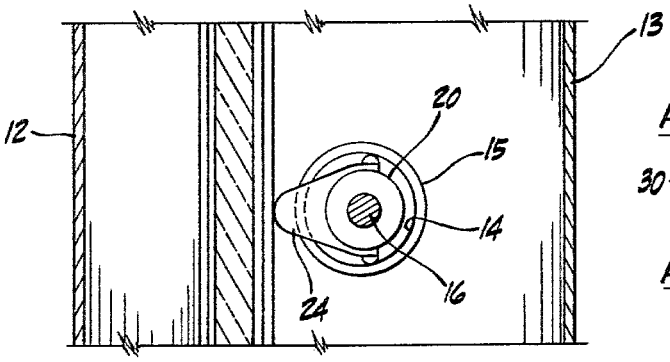
FIG. 3 is a fragmentary, bottom plan view of the assembly shown in FIG. 1.

The lock button 17 is selectively movable between door-locking and door-unlocking positions. When located in the door-locking position, the lock button 17 is depressed and is received in the housing 22 as is illustrated in full lines in FIGS. 1 and 2. In this door-locking position, the upper surface of the button head 21 of button 17 does extend slightly out of the top of housing 22, but such upper surface is rounded and protected by the surrounding housing 22 so that it cannot be effectively gripped digitally or by any instrument so as to move the lock button 17 out of its door-locking position. When the lock button 17 is located in its door-unlocking position, it is raised substantially out of the housing 22 as is shown in phantom lines in FIGS. 1 and 2.

The housing 22 includes a pair of diametrically opposed side apertures 27. The lock button 17 is provided with relatively smooth surfaces exposed through apertures 27. The apertures 27 are each of a size proportioned to permit manual access to and actuation of the lock button 17 when in the door-locking position, and to preclude effective gripping actuation of the lock button 17 when in the door-locking position by any instrument such as a wire or hook.

Figure 4:
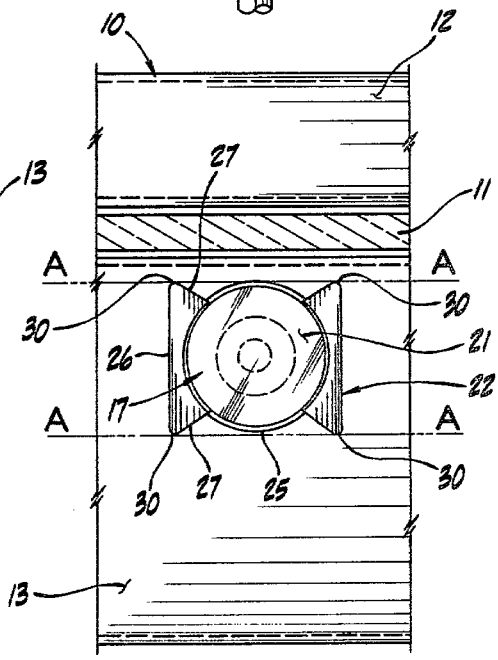
FIG. 4 is a fragmentary, top plan view of the assembly shown in FIG. 2.

Each aperture 27 is at least partially defined by lateral housing margins 30 that extend outwardly of the lock button a distance sufficient to preclude effective engagement of the lock button by an instrument extending substantially transversely of the aperture 27. More particularly, the lock button 17 is located inwardly of a substantially straight reference line A—A, best shown in FIG. 4, passed transversely between the outer edges of the lateral housing margins 30 of each aperture 27.

For ease of operation and for better shielding characteristics, the opposed apertures 27 are disposed so that one aperture faces toward the window 11 and the other aperture faces away from the window.

To install the present door-lock button assembly, the regular lock button is removed. Then, the guard housing 22 is inserted into the button opening 14 so that hook 24 underlies the opening flange 15 and points generally toward the window 11. With this juxtaposition of the housing 22, the apertures 27 are disposed so that one faces toward the window and the other faces away from the window. Then, the present lock button 17 is inserted into the housing 22 and is threadedly attached to the lock rod 16 so that the lock button 17 stops against the housing 22 when located in the door-locking position as illustrated in full lines in FIGS. 1 and 2.

In operation, the user can readily move the lock button 17 digitally between the door-locking position and the door-unlocking position. To move the lock button 17 to the door-locking position, the user simply depresses the lock button 17. To move the lock button 17 to the door-unlocking position, the user simply grips the lock button 17 digitally through the apertures 27 and lifts the lock button 17.

However, it will be understood that when the door 10 is closed, and the lock button 17 is located in its door-locking position, it is extremely difficult if not impossible for someone outside the vehicle to insert an instrument such as a wire or the like, through the door opening and lift the lock button 17 from its door-locking position to its door-unlocking position. The instrument is usually formed with a hook end that cannot effectively engage the lock button 17 because of the shielding provided by housing 22. The outer edges of aperture margins 30 prevent any instrument extending transversely of the aperture 27 from effectively gripping the lock button 17. Moreover, because the lock button 17 is provided with continuously, substantially smooth surfaces on all exposed surfaces when in the door-locking position, and especially on those surfaces exposed through the apertures 27, such instrument cannot grip the lock button 17 on such surfaces with sufficient friction to lift the lock button 21.

Accordingly, this assembly provides an effective deterrent to unauthorized entry into a locked automobile.

I claim as my invention:

1. A door-lock button assembly for use on a door, the assembly comprising:

(a) an inside door frame element, (b) a lock button selectively movable between door-locking and door-unlocking positions, (c) a housing mounted on the door frame element and embracing the lock button, the housing being provided with an aperture, the lock button being located out of the housing for digital access when in the door-unlocking position, and being digitally movable into the housing to the door-locking position, (d) the lock button including relatively smooth surfaces exposed through the aperture when in the door-locking position, and (e) the aperture being of a size proportioned for permitting digital access to and actuation of the lock button to the door un-locking position when in the door-locking position and for precluding effective gripping actuation of the lock button to the door-unlocking position when in the door-locking position by an instrument such as a wire or hook, the lock button being without any upwardly facing edge that can be gripped by an instrument when the lock button is in either the door-locking or door-unlocking position.

2. A door-lock button assembly as defined in claim 1, in which:

(f) the aperture is at least partially defined by transversely spaced lateral housing margins that extend radially outwardly of the lock button a distance sufficient for precluding effective engagement of the lock button by an instrument extending substantially transversely of the aperture, and the lateral margins being transversely spaced for permitting digital access to and actuation of the lock button to the door-unlocking position when in the door-locking position.

3. A door-lock button assembly as defined in claim 1, in which:

(f) the aperture is at least partially defined by transversely spaced lateral housing margins that extend radially outwardly of the lock button a distance so that the lock button is located inwardly of a substantially straight reference line passed transversely between the spaced outer edges of the lateral housing margins for precluding effective engagement of the lock button by an instrument extending substantially transversely of the aperture, and the lateral margins being transversely spaced for permitting digital access to and actuation of the lock button to the door-unlocking position when in the door-locking position.

* * * * *